US009834934B1

(12) United States Patent
Hodges, Jr. et al.

(10) Patent No.: US 9,834,934 B1
(45) Date of Patent: Dec. 5, 2017

(54) CONCEALED PANEL CLIP FOR STANDING SEAM ROOF SYSTEM

(71) Applicant: BLUESCOPE BUILDINGS NORTH AMERICA, INC., Kansas City, MO (US)

(72) Inventors: Robert Edward Hodges, Jr., Memphis, TN (US); Clifton D. Hyder, Collierville, TN (US)

(73) Assignee: Bluescope Buildings North America, Inc., Kansas City, MO (US)

( * ) Notice: Subject to any disclaimer, the term of this patent is extended or adjusted under 35 U.S.C. 154(b) by 0 days.

(21) Appl. No.: 15/173,250

(22) Filed: Jun. 3, 2016

(51) Int. Cl.
*E04D 3/36* (2006.01)
*E04D 3/367* (2006.01)
*E04D 3/362* (2006.01)
*E04D 3/363* (2006.01)

(52) U.S. Cl.
CPC ..... *E04D 3/364* (2013.01); *E04D 3/362* (2013.01); *E04D 3/363* (2013.01)

(58) Field of Classification Search
CPC ..... E04D 3/364; E04D 3/362; E04D 3/368; E04F 13/0864
USPC ..... 52/520
See application file for complete search history.

(56) References Cited

U.S. PATENT DOCUMENTS 4,184,299 A 1/1980 East
4,193,247 A * 3/1980 Heckelsberg ..... E04D 3/361 403/206
4,213,282 A * 7/1980 Heckelsberg ..... E04D 3/362 52/404.2
4,224,775 A 9/1980 Heckelsberg
4,361,998 A 12/1982 Ellison et al.
4,495,743 A 1/1985 Ellison et al.
4,522,005 A 6/1985 Seaburg et al.
5,001,882 A * 3/1991 Watkins ..... E04D 3/362 52/478
RE33,563 E 4/1991 Heckelsberg
RE33,566 E 4/1991 Heckelsberg
5,222,341 A * 6/1993 Watkins ..... E04D 3/362 52/478
5,911,663 A * 6/1999 Eidson ..... E04D 3/3608 52/409
6,715,256 B1 4/2004 Fischer
7,730,694 B1 6/2010 Simpson et al.
7,984,596 B1 * 7/2011 Simpson ..... E04D 3/364 52/478
8,091,312 B2 1/2012 Simpson et al.

* cited by examiner

*Primary Examiner* — Paola Agudelo
(74) *Attorney, Agent, or Firm* — Lathrop Gage L.L.P.

(57) ABSTRACT

A standing seam roof clip system has a clip base with a horizontal portion and a vertical portion extending upwardly therefrom, and a clip tab comprising a return bend having a "U" configuration extending from a lower end of a vertical back surface, and a top portion comprising a hook for engaging with a roof panel. An interlocking element is formed in the vertical portion of the clip base, and has at least one seat with a substantially a "J" configuration which extends upwardly and outwardly from the vertical portion of the clip base and a respective shoulder extending from a top edge of the vertical portion of the clip base in a reverse "U" configuration. A roof panel is joined to the roof clip via the clip tab to form a seam; and the clip tab return bend engages with the clip base shoulder and seat.

22 Claims, 7 Drawing Sheets

10
200
110
114
112
102
104
106
108
115
115
115

10
200
100
101
102
104
106
108
110
112
114
115
116
120
122
123
124
125
126
128
130
132
134
136
140
142
144
145
146
148
150
152
154
156
158
160
162
164
166
168
170
172
174
176
178
180
182
184
186
188
190
192
194
196
198
200
202
204
206
208
210
212
214
216
218
220
222
224

CONCEALED PANEL CLIP FOR STANDING SEAM ROOF SYSTEM

BACKGROUND OF THE INVENTION

Standing seam roof systems (SSRS) are applied over new metal building structures, or as retrofit systems over existing building roofs. Usually, these roof systems include roll-formed steel or aluminum roof panels. The panels may be roll formed in a fabrication shop and then delivered to the job site, or may be rolled at the job site with portable roll forming equipment. SSR systems are designed to be able to resist environmental loading such as rain, snow, hail, and wind and to remain weather tight. Specialized hold down clips have been designed to accomplish this task, and are future utilized to hold the roof panels to the substructure. These hold down clips are often rigid and restrictive in order to provide the necessary resistance to the forces (e.g., uplift forces) that the roof routinely experiences. However, the roof panels expand and contract due to, among other things, temperature fluctuations. A hold down clip that restricts movement of the panels due to uplift forces yet provides flexibility for the panels to shift may be desirable.

SUMMARY OF THE INVENTION

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

In one embodiment, a standing seam roof clip system has a clip base with a horizontal portion and a vertical portion extending upwardly therefrom, and a clip tab comprising a return bend having a "U" configuration extending from a lower end of a vertical back surface, and a top portion comprising a hook for engaging with a roof panel. An interlocking element is formed in the vertical portion of the clip base, and has at least one seat with a substantially a "J" configuration which extends upwardly and outwardly from the vertical portion of the clip base and a respective shoulder extending from a top edge of the vertical portion of the clip base in a reverse "U" configuration. A roof panel is joined to the roof clip via the clip tab to form a seam; and the clip tab return bend engages with the clip base shoulder and seat.

In another embodiment, a standing seam roof clip system includes a clip base and a clip tab. The clip base includes a substantially horizontal portion and a vertical portion extending upwardly from the horizontal portion in an "L" configuration. An interlocking element is formed in the vertical portion and includes at least one seat having substantially a "J" configuration formed into and extending upwardly and outwardly from the vertical portion of the clip base; and a respective shoulder extending from a top edge of the vertical portion of the clip base in a reverse "U" configuration. The clip tab has a return bend having a "U" configuration extending from a lower end of a substantially vertical back surface, and a top portion comprising a hook for engaging with a roof panel. A plurality of apertures are formed into the clip base horizontal portion in a predetermined pattern. Additionally, the clip base vertical portion further includes at least one tab support extending perpendicularly therefrom. A roof panel is joined to the roof clip via the clip tab to form a seam; and the clip tab return bend engages with the clip base shoulder and seat to prevent vertical movement of the roof panel due to uplift forces.

WRITTEN DESCRIPTION

Figure 1:
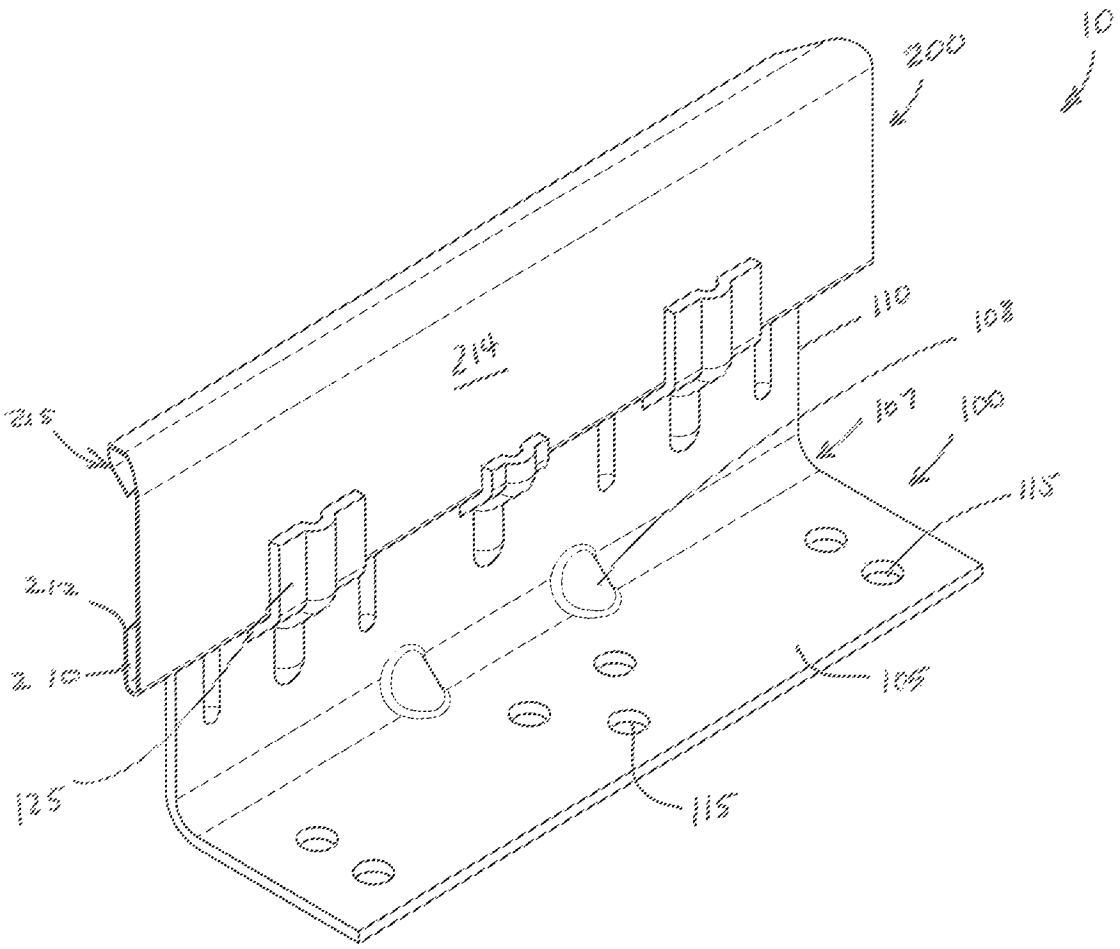
FIG. 1 is a front perspective view of a panel clip according to one embodiment of the invention.

The present invention is directed to improved embodiments of standing seam roof systems which are typically applied over metal building structures, or as a retrofit roof system for existing buildings. Standing seam roof systems usually include roll formed steel or aluminum roof panels, which may be roll formed in a fabrication shop and delivered to the job site, or alternately, rolled at the job site with portable roll-forming equipment. The roof panels may be secured to the substructure with specialized hold down clips, which may allow the panels to move somewhat freely without damaging the substructure. The clips may be concealed below, and inside a high rib of the SSRS roof panels. Hold down clips thus provide for the structural connection between the SSRS panels and the subframing (e.g., steel framing, steel decking, wood framing, wood decking, concrete, etc.) without the need for fasteners that are exposed to the weather.

There are many considerations that go into the design of the clips, including the temperature range that the SSRS will be exposed to from the outside, the average temperature inside the substructure, how large the SSRS panels are (and especially, the distance between the expansion joints which allow the panels to move), and the coefficient of thermal expansion of the connected elements.

SSRS panels and clips may be connected together with interlocking folds that may be partially formed during the panel rolling process. The SSRS clips may include clip tabs which may be formed to match the configuration of a high rib of the SSRS panel such that a tight fit is achieved between the SSRS panel and the corresponding clip. In a typical configuration, two SSRS panels may be interlocked, with the SSRS clip sandwiched between female and male ribs of the respective SSRS panels. To form the tight connection between the SSRS panels and clips, an electric seaming machine with uniquely shaped forming wheels, which may match the SSRS panel configuration, completes the interlocking processes by inelastically intertwining the clip and the panel into an interlocked seam.

SSRS are designed to be remain weather tight in undesirable environmental conditions, such as rain, snow, hail, and wind. Due to the exposure to these adverse elements, SSRS may include coatings designed to resist the effects of corrosion and weathering. SSRS panels are designed to expand and contract with changes in temperatures independent of the supporting substructure. However, traditional hold down clips may be rigid and restrictive, thus preventing the free movement of the SSRS panels.

The standing seam roof systems disclosed herein provide overall improved performance and flexibility as compared to prior art systems. The present invention utilizes a two piece configuration comprising roof panels that interlock in a unique way via a specially designed roof clip such that the overall performance of the roof system is significantly improved and is more economical. As described in detail below, the uniquely designed clip may have increased resistance to wind or uplift forces and increased ability to translate horizontally to accommodate greater roof run distances and/or movement of the roof panels due to temperature fluctuations.

Referring now to the figures, the roof clip assembly 10 includes a clip base 100 and a clip tab 200. The clip tab 200 is in slideable engagement with the clip base 100. As will become apparent from the description below, the clip base 100 is secured to a substructure 20 (FIG. 6), and the clip tab 200 connects to the roof panels to provide means for movably securing roof panels to the substructure 20.

Figure 2:
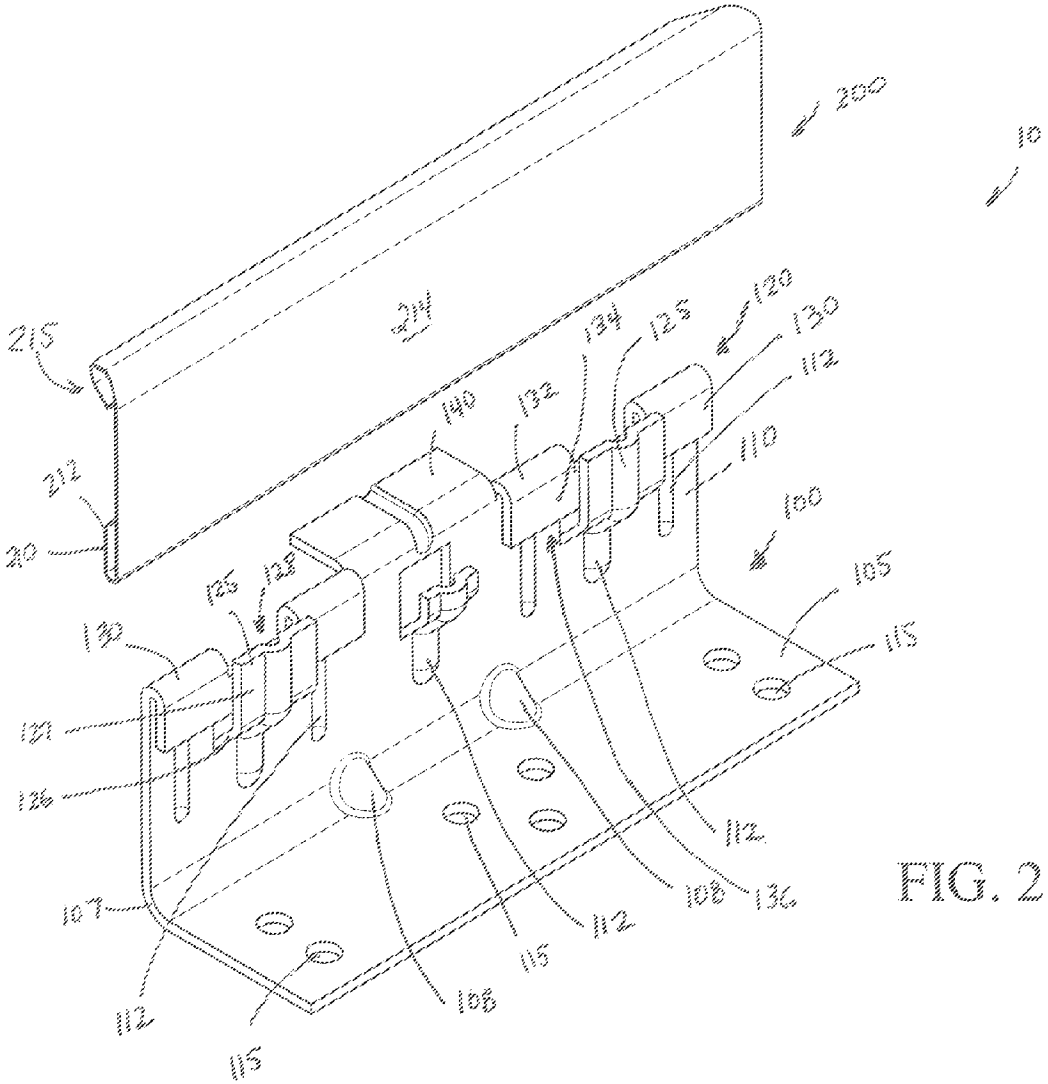
FIG. 2 is a blown up front perspective view of the panel clip of FIG. 1.
Figure 4:
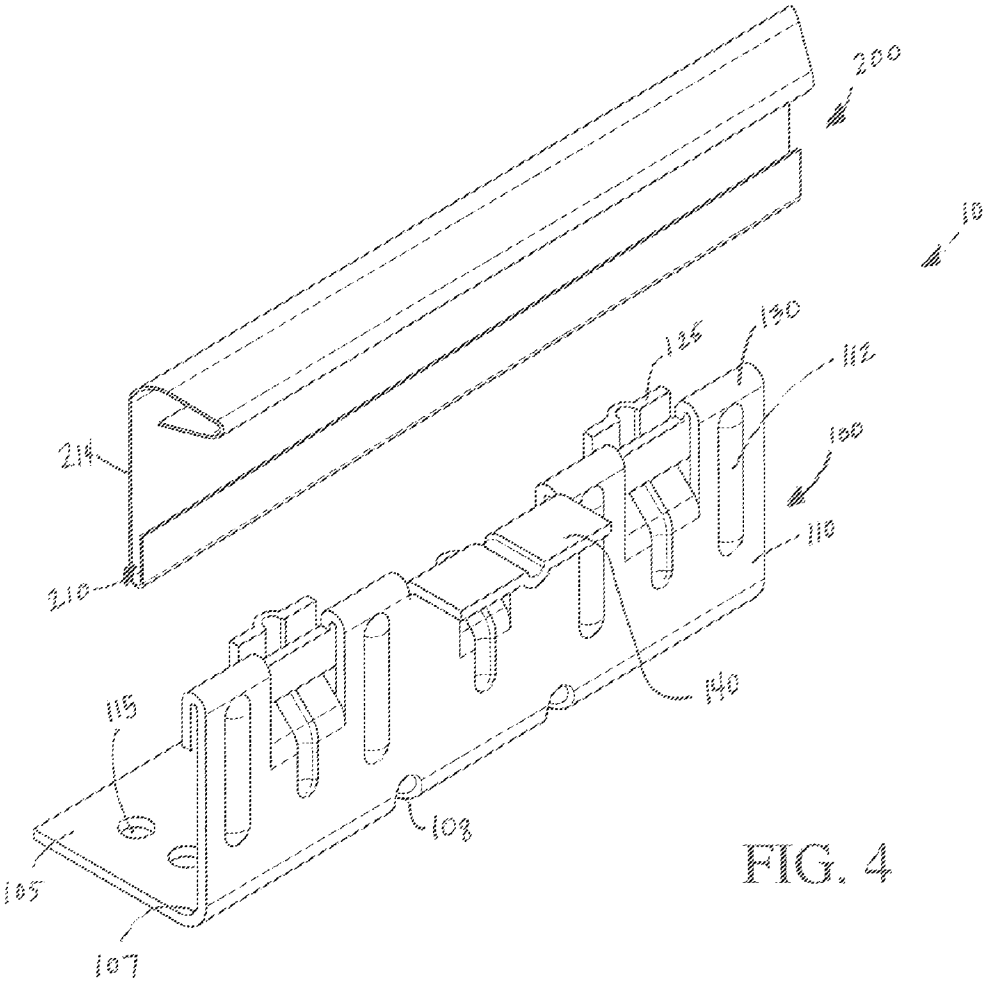
FIG. 4 is a blown up rear perspective view of the panel clip of FIG. 1.

With reference now to FIGS. 2 and 4, the clip base 100 comprises an "L" shaped member having a bottom horizontal portion 105 extending to a substantially 90 degree bend 107 leading to a back vertical portion 110. Reinforcement ribs 112 may be stamped into the back vertical portion 110. The reinforcement ribs 112 may provide strength to the clip base 110 and prevent buckling due to compression forces received by the SSRS. The bend 107 may additionally include areas of reinforcement 108.

Figure 6:
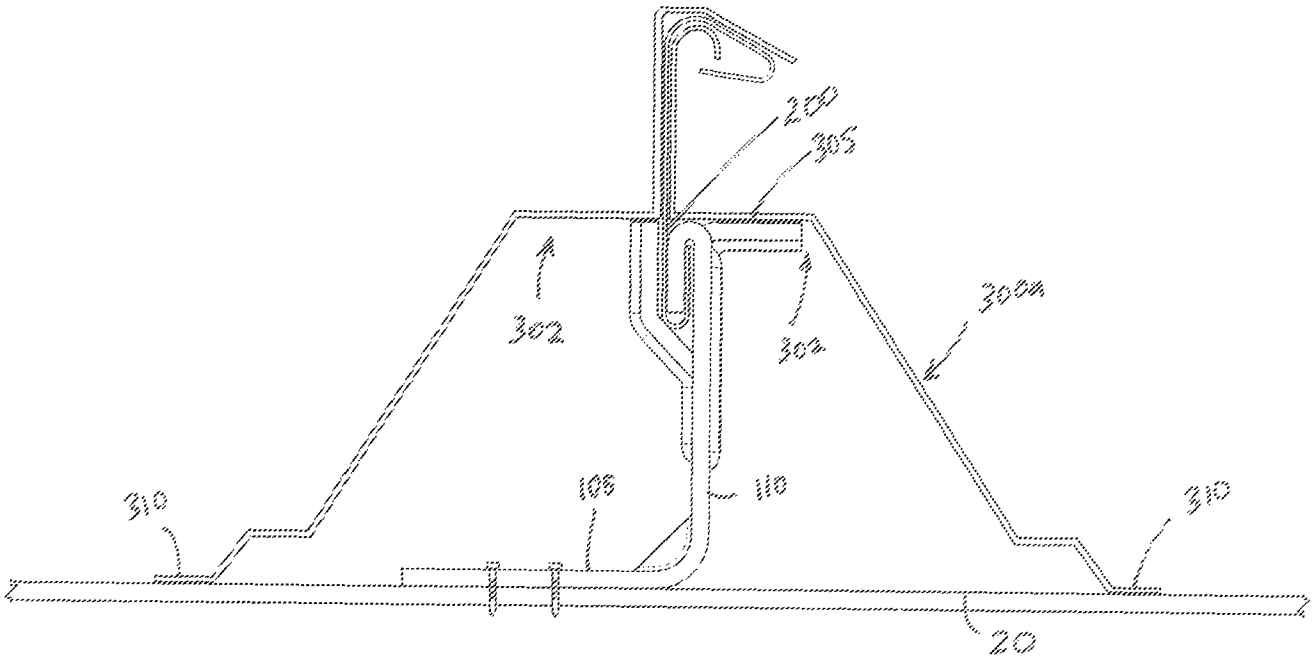
FIG. 6 is a section view of the panel clip of FIG. 1 engaged with a roof panel.

A plurality of apertures 115 may be formed into the bottom portion 105 for engaging with the substructure 20 (FIG. 6). The apertures 115 may be provided in a variety of predetermined sizes and/or pattern configurations which may allow the clip base 100 to attach to any substructure 20. The pattern of the apertures 115 formed in the bottom portion 105 may be determined based on the length and width of the bottom portion 105, as well as the particular requirements of the supporting structure. For example, the apertures 115 may be configured to accommodate, for example, steel cold formed purlins, bar joists, steel decking, wood decking, wood joists, and other secondary support systems.

Z purlins are commonly used in the metal building industry as substructure 20. Z purlins have a tendency to rotate torsionally when loaded. Typically, to prevent the torsional rotation, the z-purlins require independent bracing. Here, the pattern of the apertures 115 formed into the bottom portion 105 of the clip base 110 may be configured such that, when the clip base 100 is secured to the substructure 20, the clip 10 recognizes increased resistance to torsional rotation. In operation, the torsional forces are transferred from the z purlin to the clip base 100 and into the clip tab 200. The forces may be transferred even when the clip tab 200 is shifted from its preferred position due to thermal expansion or contraction of the SSRS. Thus, the need for additional torsional bracing is advantageously eliminated.

The clip base 100 may be secured directly to the supporting substructure 20 via the apertures 115 using any appropriate mechanical fastener, such as self-drilling screws, screw bolts, nuts and bolts, wood screws, deck screws, shot pins, rivet, et cetera. Further, the clip base 100 may be secured to the substructure 20 via welding, such as spot welding, for example.

Moving on, the back vertical portion 110 may include at least one tab interlocking element 120, comprising a seat 125 and a shoulder 130. The seat 125 may be punched out of the back vertical portion 110 and have a substantially "J" configuration. Thus, the seat 125 may include a bottom portion 125 extending outwardly from the back vertical portion 110 and a spine 127, forming an upwardly directed opening 128 therein.

The shoulder 130 may extend 180 degrees downwardly from the back vertical portion 110 to form an inverted "U" having an upper curved portion 132 and a vertical portion 134, forming a space 136 therebetween (FIG. 2). The shoulder vertical portion 134 may extend into the upwardly directed opening 128 of the seat 125. The shoulder 130 may extend the majority of the length of the clip base 100 to engage as much of the clip tab 200 as possible. In one embodiment, illustrated by the figures, the clip base 100 includes two shoulders 130, one on either end of the clip base 100. It may be advantageous for the shoulder(s) 130 to extend the majority of the length of the clip base 100 so that the upper curved portion 132 may support the high rib 302 of the roof panel 300 (FIG. 6). The horizontal portion 305 of the roof panel high rib 302 may rest firmly on the shoulders 130 to provide support for gravity loading (e.g., foot traffic, snow, et cetera).

The clip base 100 may further include additional tab supports 140 which may extend outwardly in a direction perpendicular to the back vertical portion 110. The tab supports 140 may provide still additional support for the high rib 302 of the roof panel 300, as illustrated in FIG. 6. In combination, the shoulder(s) 130 and the tab supports 140 may be sufficient to support a substantial majority of the SSRS panel during periods of downward loading.

Figure 3:
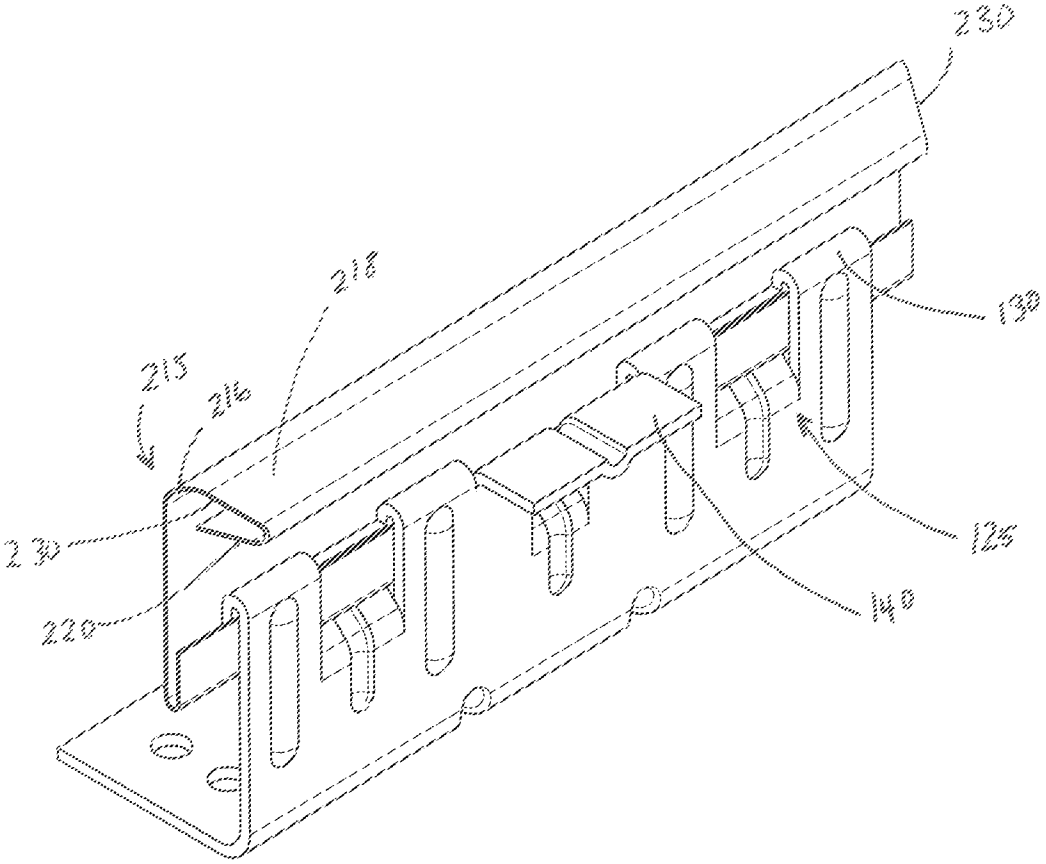
FIG. 3 is a rear perspective view of the panel clip of FIG. 1.
Figure 5:
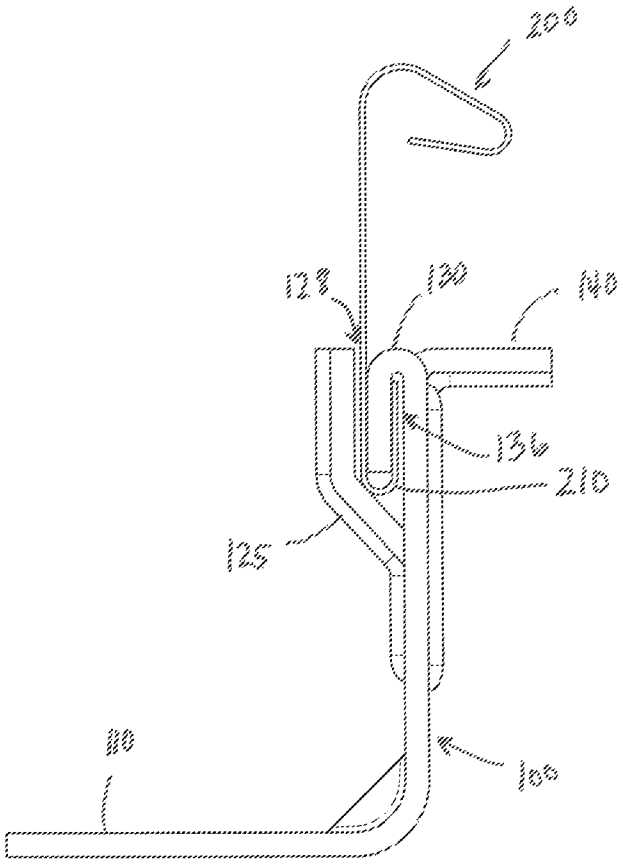
FIG. 5 is a side view of the panel clip of FIG. 1.

Continuing on, the clip tab 200 may be configured to slideably engage with the clip base seat 125 and the shoulders 130. Accordingly, the clip tab 200 may be formed at the bottom by a "U" shaped return bend 210 extending from a substantially vertical back surface 214. The return bend 210 may initially slideably engage with a shoulder 130 located at a first end of the clip base 100. The return bend 210 may be respectively received by the shoulder 130 such that a free end 212 of the return bend 210 rests in the space 136 formed by the shoulders 130 (FIGS. 1, 3, 5). The clip tab 200 may then be slid into position, wherein the clip tab 200 is fully engaged with the respective shoulder(s) on the clip base 100. The return bend 210 may further rest in the seats 125 formed into the clip base 100.

The combination of the seats 125 and the shoulders 130, when engaged with the clip tab 200, prevents vertical movement of the clip tab 200 as a result of uplift loads on the roof. However, the clip tab 200 is allowed to freely slide longitudinally as a result of shifting roof panels 300. The clip tab 200 may only be limited in its longitudinal slide length by the length of the clip base 100, as the clip tab 200 may be unable to maintain connection of the roof panels 300 with the substructure 20 if the clip tab 200 becomes unconnected from the clip base 100. However, the seat 125 and shoulders 130 may be designed to allow the clip base 100 to maintain excellent resistance to uplift forces, even when the slide limits are approached (e.g., near disengagement of at least one end of the clip tab 200 from the respective interlocking member 120).

As noted above, the clip tab 200 may be allowed to freely slide longitudinally along the length of the clip base 100. The clip base 100 may be configured to engage with any length clip tab 200. For sliding clip tabs 200, such as those described herein, the range of longitudinal movement may be virtually unrestricted in order to accommodate various amounts of panel movement. Thus, as is understood by those in the art, the roof clip 10 simultaneously provides for anchorage of the SSRS panels to the supporting substructure while resisting uplift forces and for the clip to freely float due to movement of the roof panels caused by thermal expansion and contraction.

Floating roof systems may still require a point of anchorage somewhere along the length of the panel 300 to ensure that the panels 300 stay connected to the substructure. At the point of anchorage, no movement of the panels 300 is allowed, and the longitudinal forces from downslope drag loads are delivered from the point of anchorage to the substructure. The exact position of the anchorage may vary. Accordingly, another embodiment of the clip assembly may include a base portion 100 and a clip portion 200 that are fixed together such that sliding is prevented.

The clip tab 200 may be connected to the roof panels 300 via a top portion hook 215. The top portion 215 of the clip tab 200 may be uniquely formed to match the unseamed shape of the SSRS panel 300, as required by the particular panel. In one embodiment, illustrated best in FIG. 3, the top portion 215 extends from the back surface 214 and includes an approximately 90 degree bend 216 from the back surface 214, leading to a substantially horizontal portion 218. The horizontal portion 218 concludes in a 180 degree bend 220 to complete the top portion 215.

Figure 7B:
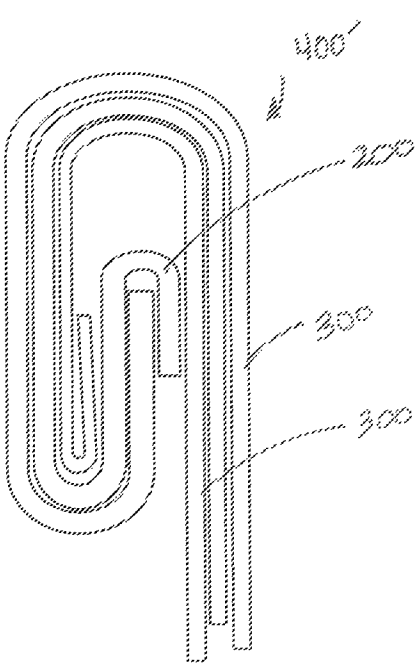
FIG. 7*b* is a close up view of a 360 degree seam with a reverse hook formed between the panel clip and the roof panel, according to another embodiment of the invention.
Figure 7A:
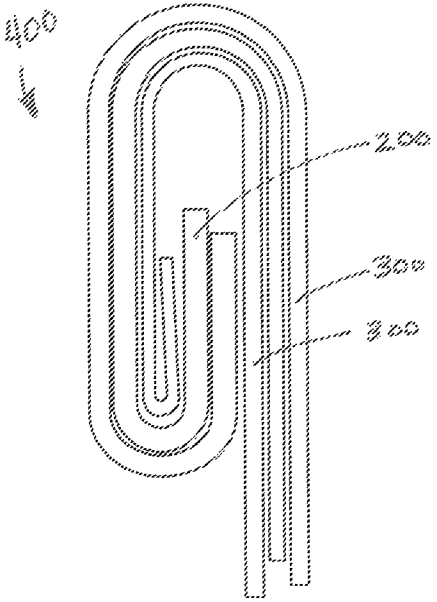
FIG. 7*a* is a close up view of a 360 degree seam formed between the panel clip and the roof panel, according to one embodiment of the invention.

The clip tab top portion 215 may be formed to match the unseamed shape of the respective SSRS panel 300, as required. The clip tab top portion 215 may be roll formed with the SSRS panels according to known technology (e.g., with an electric seaming machine). The respective SSRS panels and the clip tab 200 may be inelastically folded to form a complimentary 360 degree seam 400 (FIG. 7*a*). Alternately, the respective SSRS panels and the clip tab 200 may be inelastically folded to form a 360 degree seam having a reverse bend 400' (FIG. 7*b*).

Typically, under uplift loading, the seams 400, 400' formed between the SSRS panels 300*a*, 300*b* receive a significant amount of force, causing the flat sections 310 of the panels to bow upwards between the high ribs 302. This may cause the seams 400, 400' to pull apart. Therefore, one of ordinary skill in the art may recognize that the 360 degree seam with the reverse bend 400' may be preferable to prevent the seams 400' from pulling apart when the SSRS experiences uplift loading. When extreme uplift loads are applied to the SSRS panels 300, and the SSRS panels 330 would otherwise begin to pull apart at the seams 400', the reverse bend 405 locks the panels 300 in place on the clip 10. Accordingly, greater loads can be recognized without damaging the SSRS panels 300 and/or clips 10.

The electric seaming machine must have rollers designed to join the SSRS panels and clip tab 200 tightly together according to the various configurations described herein or otherwise known in the art. In order to accomplish this, the clip tabs 200 may be joined to the roof panels in sections. However, a single clip 10 may not extend the entire length of the roof panel. Accordingly, in order to accommodate smooth run-on of the rollers of the electric seaming machine onto the clip tab 200, the clip tab 200 may be equipped with mitered ends 230 to prevent the rollers from pushing the clip tab 200 as the rollers move over the clip tab ends 230. The mitered ends 230 may prevent sudden impacts to the edge of the clip tab 200 by the seaming machine. If the seaming machine hits a squared-off end, the clip tab 200 may be pushed forward and out of the desired position. Therefore, the mitered ends 230 may keep the seaming machine rollers from pushing the clip tab 200 off center as it runs therealong. The clip tab 200 may be mitered at both ends to accommodate seaming operations in either direction.

The clip tab 200 and/or roof panels 300 may additionally be provided with a bead of sealant to afford further resistance to moisture penetration. A sealant bead may be optionally applied inside the bend 216 in the top portion 215 of the clip tab 200. A sealant bead may additionally be place at an underside of the unseamed female SSRS panel 300*b*. In this way, as the seaming machine rolls along the length of the panels 300*a*, 300*b* to form the seals 400, 400', the sealant beads may flow together at the ends of the clip tab 200. It may be understood by those of skill in the art that the sealant beads are preferably aligned as described above to ensure that the clip tab 200 is completely encapsulated with sealant on both side of the clip tab 200, including around the ends 230 of the clip tab 200.

The roof clip 10 may be made of any appropriate material, such as strengthened plastic, steel, aluminum, et cetera. In a preferred embodiment, the clip assembly 10 is manufactured from stainless steel, and is factory assembled such that the clip tab 200 is engaged with the clip base 100 to form the clip assembly 10, which is shipped at one piece.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention. Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the embodiments described herein.

The invention claimed is:

1. A standing seam roof clip system, comprising:

a clip base comprising a substantially horizontal portion and a vertical portion extending upwardly from the horizontal portion in an "L" configuration, and an interlocking element formed in the vertical portion, wherein the interlocking element comprises:

at least one seat having substantially a "J" configuration formed into and extending upwardly and outwardly from the vertical portion of the clip base; and a respective shoulder extending from a top edge of the vertical portion of the clip base in a reverse "U" configuration; and a clip tab slidably receivable onto the at least one clip base seat wherein the clip tab is capable of unrestrained longitudinal translation along the entire length of the base seat, the clip tab comprising a return bend having a "U" configuration extending from a lower end of a substantially vertical back surface, and a top portion comprising a hook for engaging with a roof panel;

wherein:

a roof panel is joined to the roof clip via the clip tab to form a seam; and the clip tab return bend engages with the clip base shoulder and seat to prevent vertical movement of the roof panel due to uplift forces.

2. The system of claim 1, wherein a plurality of apertures are formed into the substantially horizontal portion of the clip base in a predetermined pattern.

3. The system of claim 2, wherein the predetermined pattern is determined based on the configuration of a substructure to which the clip base is secured.

4. The system of claim 3, wherein the clip base is secured to the substructure by a mechanical fastener selected from the group consisting of a screw, nut and bolt, shot pin,-rivet, and welding.

5. The system of claim 1, wherein the seam comprises a 360 degree U-turn seam.

6. The system of claim 1, wherein the seam comprises a 360 degree U-turn seam having a reverse bend.

7. The system of claim 1, wherein the clip tab is allowed to slide freely in the longitudinal direction with movement of the roof panel.

8. The system of claim 7, wherein the clip tab is slidably secured to the clip base, wherein the clip base is secured to a substructure and wherein movement of the clip base is restricted in both the horizontal and vertical directions.

9. The system of claim 1, wherein the clip base further includes at least one area of reinforcement formed therein, the reinforcement areas being located at the an intersection of the horizontal portion and the vertical portion.

10. The system of claim 1, wherein a sealant bead is provided in the clip tab top portion hook.

11. The system of claim 1, wherein the vertical portion of the clip base further includes a plurality of reinforcement ribs formed therein.

12. The system of claim 1, wherein the clip tab top portion is configured to match an unseamed shape of the panel.

13. The system of claim 12, wherein the clip tab is inelastically roll formed to the panel.

14. The system of claim 1, further comprising at least one tab support extending perpendicularly from a top edge of the clip base vertical portion.

15. The system of claim 1, wherein ends of the clip tab top portion are mitered.

16. A standing seam roof clip system, comprising:

a clip base with oppositely disposed substantially vertically oriented edges, the clip base comprising a substantially horizontal portion and a vertical portion extending upwardly from the horizontal portion in an "L" configuration, wherein an interlocking element is formed in the vertical portion, the interlocking element comprising:

at least one seat having substantially a "J" configuration formed into and extending upwardly and outwardly from the vertical portion of the clip base; and a respective shoulder extending from a top edge of the vertical portion of the clip base in a reverse "U" configuration; and a clip tab configured for unrestrained slidable longitudinal translation along the at least one clip base seat, the clip tab comprising a return bend having a "U" configuration extending from a lower end of a substantially vertical back surface, and a top portion comprising a hook for engaging with a roof panel;

wherein:

the clip base vertical portion further comprises at least one tab support extending perpendicularly therefrom;

a roof panel is joined to the roof clip via the clip tab to form a seam; and the clip tab return bend engages with the clip base shoulder and seat to prevent vertical movement of the roof panel due to uplift forces.

17. The system of claim 16, wherein the vertical portion of the clip base further includes a plurality of reinforcement ribs formed therein.

18. The system of claim 16, wherein the clip tab is allowed to slide freely in the longitudinal direction with movement of the roof panel.

19. The system of claim 16, wherein the clip base further includes at least one area of reinforcement formed therein, the reinforcement areas being located at an intersection of the horizontal portion and the top portion.

20. The system of claim 16, wherein the seam is one of: a 360 degree U-turn seam; and a 360 degree U-turn seam having a reverse bend.

21. A method of assembling a clip tab to a clip base for use in a standing seam roof, the method comprising:

fabricating a clip base comprising a substantially horizontal portion and a vertical portion extending upwardly from the horizontal portion in an "L" configuration, and an interlocking element formed in the vertical portion, wherein the interlocking element comprises:

at least one seat having substantially a "J" configuration formed into and extending upwardly and outwardly from the vertical portion of the clip base; and a respective shoulder extending from a top edge of the vertical portion of the clip base in a reverse "U" configuration;

sliding a clip tab onto the at least one clip base seat, the clip tab comprising a return bend having a "U" configuration extending from a lower end of a substantially vertical back surface, and a top portion comprising a hook for engaging with a roof panel, the clip tab configured for unrestrained longitudinal translation along the entire length of the clip base seat; and the clip tab return bend engaging with the clip base shoulder and seat to prevent vertical movement of the roof panel due to uplift forces.

22. A method of attaching a clip tab and an associated clip base to a standing seam roof and a building purlin, the method comprising:

securing a substantially horizontal portion of a clip base to the building purlin, the clip base further comprising a vertical portion extending upwardly from the horizontal portion in an "L" configuration, and an interlocking element formed in the vertical portion, wherein the interlocking element comprises:

at least one seat having substantially a "J" configuration formed into and extending upwardly and outwardly from the vertical portion of the clip base; and a respective shoulder extending from a top edge of the vertical portion of the clip base in a reverse "U" configuration; and sliding a clip tab onto the clip base seat, the clip tab comprising a return bend having a "U" configuration extending from a lower end of a substantially vertical back surface, and a top portion comprising a hook for engaging with a roof panel, the clip tab configured for unrestrained longitudinal translation along the entire length of the clip base seat;

engaging the clip tab return bend with the clip base shoulder and seat to prevent vertical movement of the roof panel due to uplift forces, and integrating the clip tab into the roof panel to form a seam.

* * * * *